US007161098B2

(12) United States Patent
Chao et al.

(10) Patent No.: US 7,161,098 B2
(45) **Date of Patent: *Jan. 9, 2007**

(54) METHOD AND SYSTEM FOR STICKY KEY PREVENTION FOR KEYBOARD OR KEYPAD DEVICES

(75) Inventors: James Lee Chao, Durham, NC (US); Leonard Douglas Hobgood, Durham, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 1212 days.

This patent is subject to a terminal disclaimer.

(21) Appl. No.: 09/824,496

(22) Filed: Apr. 2, 2001

(65) Prior Publication Data

US 2004/0206608 A1 Oct. 21, 2004

(51) Int. Cl.
*H01H 9/00* (2006.01)

(52) U.S. Cl. ..... 200/5 A; 200/302.2; 200/345; 400/472; 341/20

(58) Field of Classification Search ..... 200/5 A, 200/5 B, 302.1–302.2, 329, 333, 293, 345; 235/380; 400/472–476; 341/20–22
See application file for complete search history.

(56) References Cited

U.S. PATENT DOCUMENTS

| | | | | | |
|---|---|---|---|---|---|
| 4,971,644 | A * | 11/1990 | Mahn et al. | ..... | 156/253 |
| 5,491,478 | A * | 2/1996 | de la Luz et al. | ..... | 341/22 |
| 5,556,695 | A * | 9/1996 | Mazelsky | ..... | 442/203 |
| 5,798,409 | A * | 8/1998 | Ho | ..... | 524/506 |
| 5,810,491 | A * | 9/1998 | Muller et al. | ..... | 400/496 |
| 5,883,161 | A * | 3/1999 | Wood et al. | ..... | 524/48 |
| 5,932,679 | A * | 8/1999 | Noto et al. | ..... | 528/39 |
| 5,969,320 | A * | 10/1999 | Leeper et al. | ..... | 235/380 |
| 6,037,483 | A * | 3/2000 | Malik et al. | ..... | 549/511 |
| 6,054,939 | A * | 4/2000 | Wei et al. | ..... | 341/20 |
| 6,063,438 | A * | 5/2000 | Ogawa | ..... | 427/213.3 |
| 6,398,436 | B1 * | 6/2002 | Chao | ..... | 400/472 |
| 6,448,957 | B1 * | 9/2002 | Chia-Hung | ..... | 345/161 |

* cited by examiner

*Primary Examiner*—Richard K. Lee
(74) *Attorney, Agent, or Firm*—Sawyer Law Group LLP

(57) ABSTRACT

A method and system of minimizing sticky keys in an electronic device having a body, circuitry, and a plurality of keypads is disclosed. The method and system comprise providing a protectant coating; and applying the protectant coating on surfaces of both the keypad and also the body to prevent sticking between the mating surfaces. A system and method is added in accordance with the present invention utilizing a protectant on critical surfaces which serves to prevent the residual buildup of contaminants following spills. In so doing the sticky key problem associated with the contaminated buildup is substantially eliminated.

9 Claims, 7 Drawing Sheets

METHOD AND SYSTEM FOR STICKY KEY PREVENTION FOR KEYBOARD OR KEYPAD DEVICES

FIELD OF THE INVENTION

The present invention relates to keyboards and keypad devices and more specifically to preventing sticky keys on keyboards or keypad devices.

BACKGROUND OF THE INVENTION

In typical usage, various types of electronic devices such as computers, cell phones, remote controls, PDAs, radios, and other electronic articles require human contact and are thus exposed to possible liquid spills and encroachment by rain, and/or water laden vapor including high humidity and fogs, etc. The cost of replacing electronic circuitry due to liquid compromise, which typically leads to shorts in the system, failure of keyboard elements and to sticky keys on keyboards and keypads, is great when considering that computer keyboards are so prevalent, and their use in daily activities, such as in cell phones and laptop computers, is so commonplace. Thus, there has been great interest in a means of protecting such electronic devices from liquid spills and the resulting sticky keys on keyboards and keypads. What is meant by keypads is any type of key button or pad which is mechanically actuated on an electronic device. The sticky key problem is mechanical: once two contact surfaces come together, they stick to each other.

Most attempts to block liquid spills in electronic devices involve the use of an impermeable liquid barrier that diverts the flow of liquids that should fall into the crevices of a keypad or keyboard. The impermeable barriers in the prior art, such as disclosed in U.S. Pat. No. 5,681,122 involve the use of a tray having walls and a spillway that is located below the external facie of the computer keyboard but above the electronic equipment, the tray having formations to allow the keys of the keyboard to float through. Spills would then fall into the spaces between the facie and keys and into the tray to be collected at the spillway. Other means of protecting electronic devices from liquid spills include such means as disclosed in U.S. Pat. No. 5,491,478, wherein a unitary molded seal membrane is sealed over the top of keys on a cell phone or keyboard keypad, thus directly blocking the flow of spills. A third protection system is a thermal heat seal of a laminated PVC membrane with the electronic traces contained within the seal. This, however, offers only limited water resistance, and breaks down over time.

There are numerous problems with the prior art protection systems. The use of such means as a tray requires that the liquid fall downwardly directly into the keypad or keyboard. This does not take into account the encroachment of moisture due to rain, fog, or spills that are substantially non-vertical. The problem with the membrane-type of barrier is that such barriers prevent free and unhindered use of the keyboard or keypad. Further, these membranes typically wear over time and become translucent or even opaque, thus requiring replacement. Since these articles must be fastened securely around the keypad or keyboard, it is not convenient for a typical user to easily replace them. As mentioned above, sealed plastic laminates offer only minimal protection and require thin silver traces, which is subject to corrosion, fatigue and cracking.

There is thus a need for an improved method of protecting the electronic circuitry and keypads and keyboards in devices such as cell phones, ATM machine keypads, laptop computer keypads, remote controls, PDAs, radios, and other devices where the threat of liquid spill or moisture exposure may be present. This need is heightened by the fact that electronic equipment such as laptop computers, cell phones, phones in phone booths, marine electronic equipment, and other electronic equipment finds more widespread outdoor use.

Accordingly, what is needed is a system and method for protecting electronic circuitry and preventing sticky keys on keyboards or keypad devices due to spills. The present invention addresses such a need.

SUMMARY OF THE INVENTION

A method and system of minimizing sticky keys in an electronic device having a body, circuitry, and a plurality of keypads is disclosed. The method and system comprise providing a protectant coating; and applying the protectant coating on surfaces of both the keypad and also the body to prevent sticking between the mating surfaces.

A system and method is added in accordance with the present invention utilizing a protectant on critical surfaces which serves to prevent the residual buildup of contaminants following spills. In so doing the sticky key problem associated with the contaminated buildup is substantially eliminated.

Furthermore, this method and system is particularly effective when used in conjunction with the application of a superabsorbent gel to provide a means for the spill to be preferentially directed away from the mechanical workings of the key buttons.

DETAILED DESCRIPTION

The present invention relates to keyboards and keypad devices and more specifically to preventing sticky keys on keyboards or keypad devices. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Figure 1:
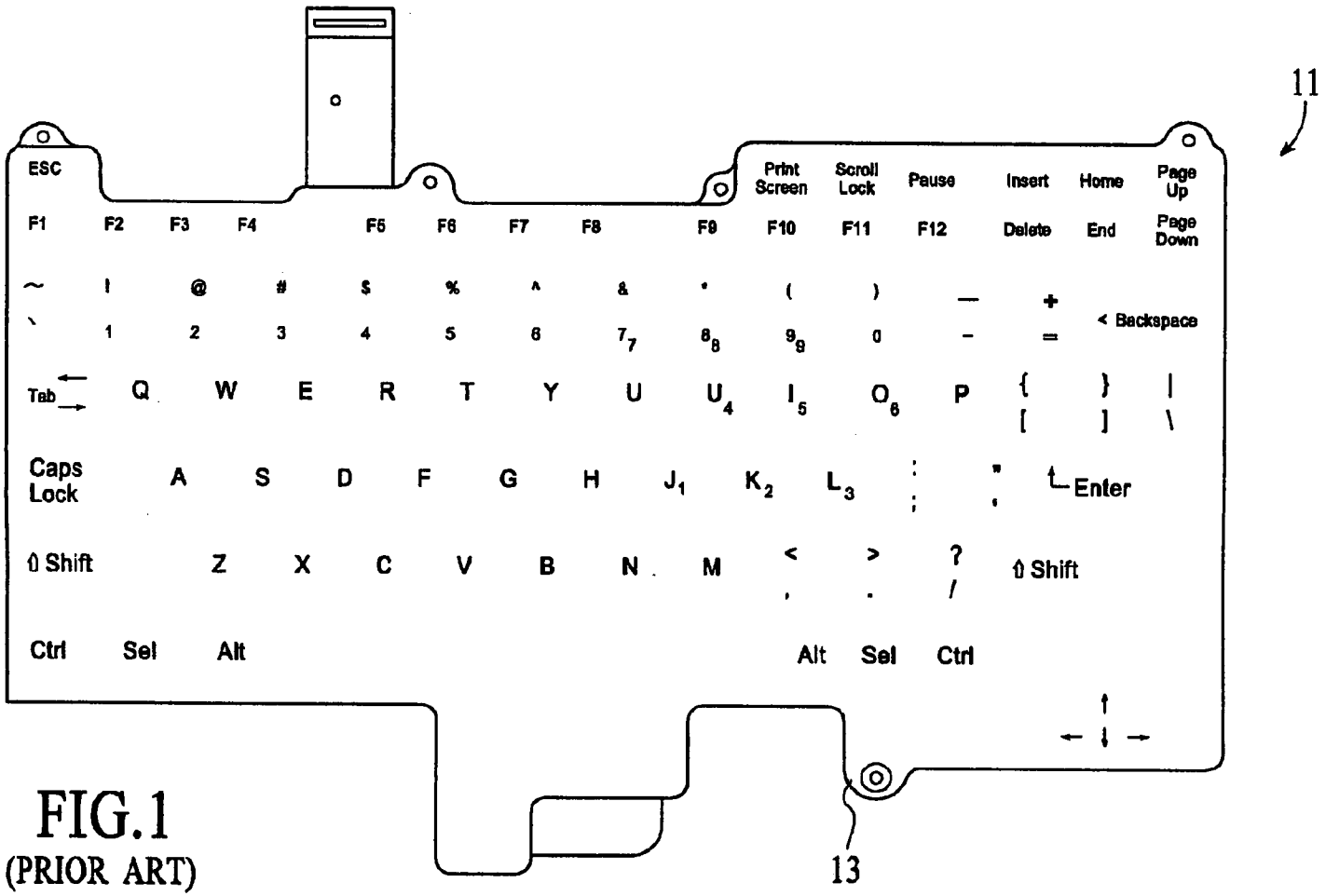
FIG.1 (PRIOR ART)
FIG. 1 is a top view of a mobile laptop keyboard assembly with prior art metal tray for spill collection.
Figure 2:
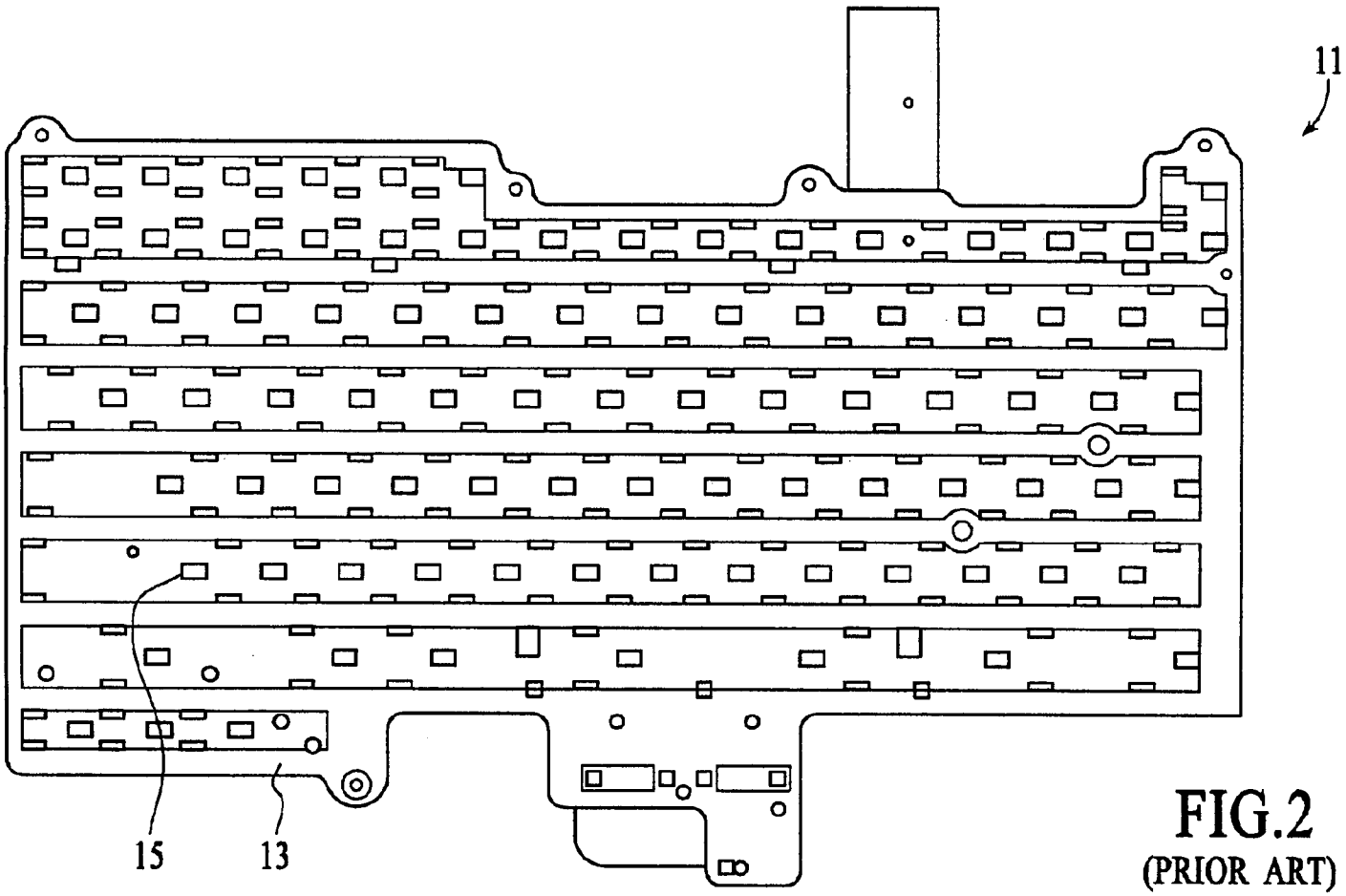
FIG.2 (PRIOR ART)
FIG. 2 is a bottom view of the keyboard in FIG. 1.
Figure 3:
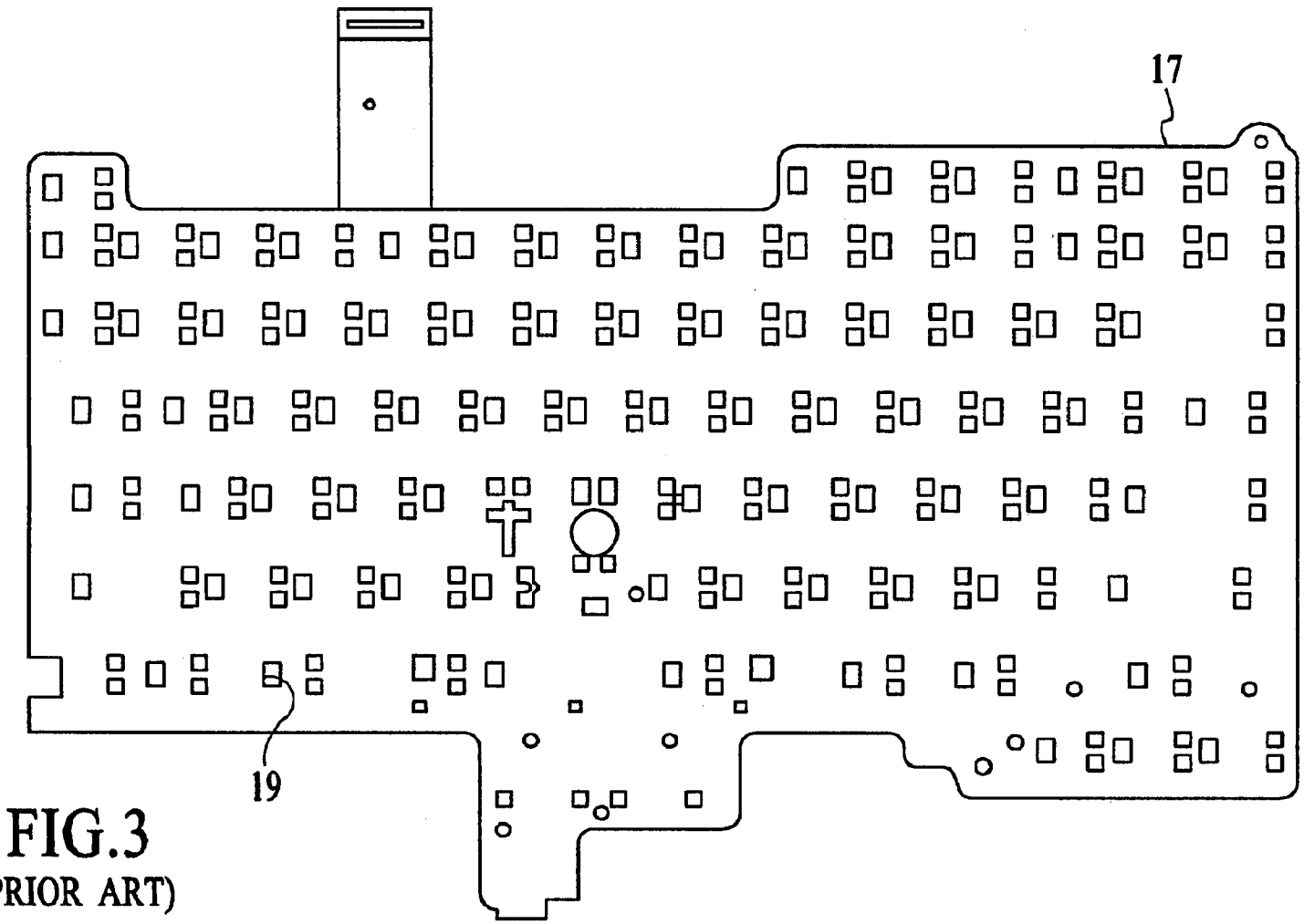
FIG.3 (PRIOR ART)
FIG. 3 is a view of the sealed silver membrane circuit assembly underlying and functionally associated with the keyboard in FIG. 1.
Figure 4:
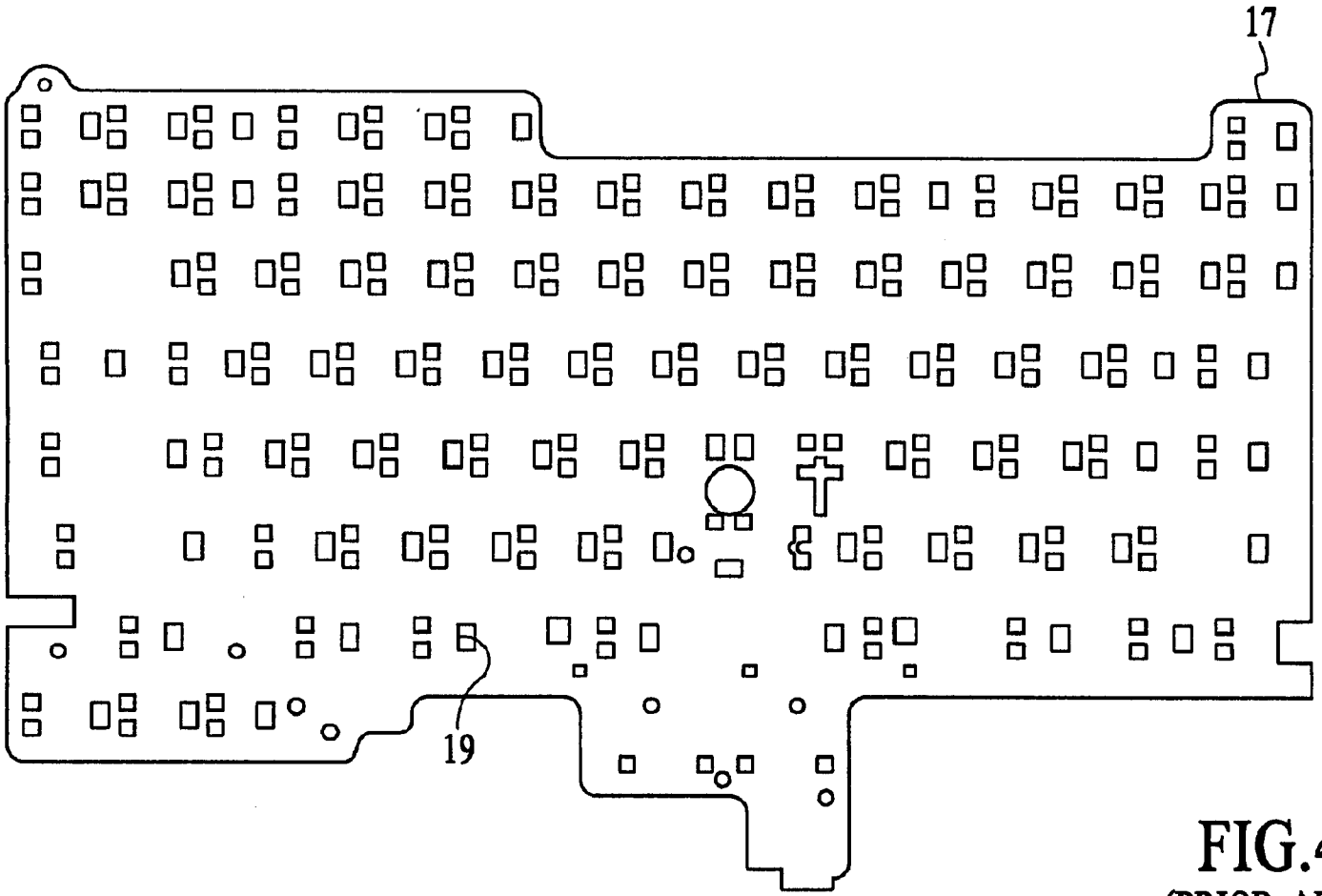
FIG.4 (PRIOR ART)
FIG. 4 is an inside view of the sealed silver membrane circuit assembly underlying and functionally associated with the keyboard in FIG. 1.

The present application is related to U.S. Pat. No. 6.398, 436, issued Jun. 4, 2002, entitled "Spill Protection for Electronic Devices" and is incorporated by reference herein. The above-identified U.S. patent application is directed to protect various types of electronic equipment, one embodiment of the invention will be described with reference to a computer keyboard as shown in FIGS. 1–4. Specifically with reference to FIG. 1, is shown the front side of a mobile laptop keyboard assembly with a prior art metal tray for spill collection. The metal tray 13 is typical in the prior art for protecting keyboards from spills. FIG. 2 shows the back side of the same keyboard 11 as in FIG. 1. The back side view of keyboard 11 in FIG. 2 shows the details of the metal tray 13. In particular, it shows various openings and other formations 15 that allow for access to and penetration of electronic and mechanical elements such as the keypad and individual keys, and other mechanical switches or elements. These keys in turn are used to encode the underlying circuitry with the circuitry on the circuit assembly 17 as shown in FIG. 3. FIG. 3 shows the outside or top portion 19 of a sealed silver membrane circuit assembly, and FIG. 4 shows the bottom portion of a sealed silver membrane circuit assembly. The circuit assembly in FIGS. 3 and 4 has openings and formations 19 that allow for access to the electronic circuitry of the circuit assembly 17. The absorbent structure of the present invention would typically be placed on top portion 19 of the circuit assembly 17 as in FIG. 3.

Figure 5:
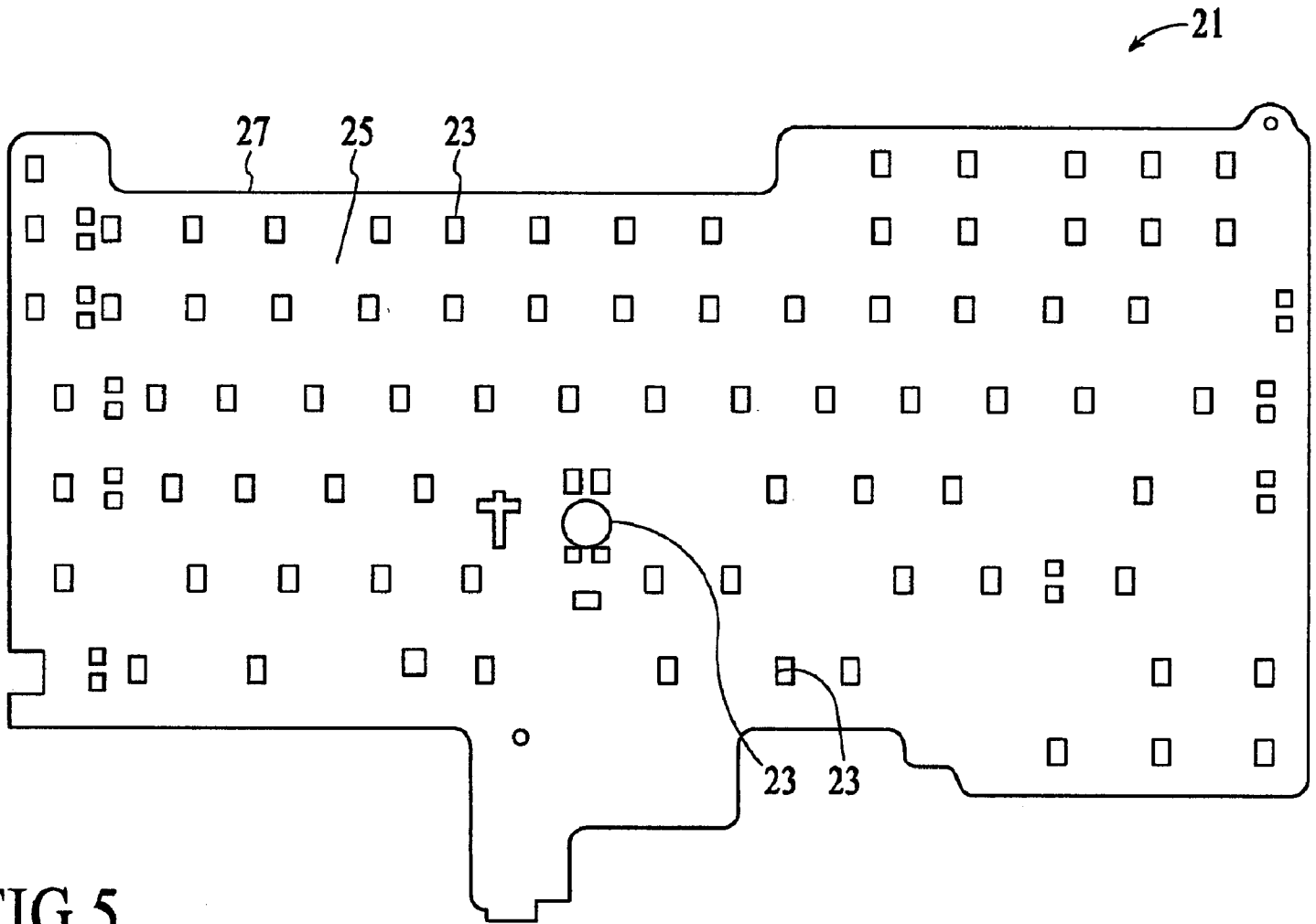
FIG. 5 is a top view of one embodiment of the absorbent structure of the invention to protect the circuit assembly of FIG. 3.

The absorbent structure of the present invention is a sheet-like form having at least a hydrogel-forming core. The sheet-like structure can have any number of other configurations, layers, thicknesses, and shapes. One embodiment of the absorbent structure of the present invention is described with respect to FIG. 5, wherein absorbent structure 21 is pre-formed or shaped to conform to the circuit assembly 17, comprising holes and formations 23 therein. Typically, the holes and formations 23 on absorbent structure 21 will substantially match the structures 19 on the circuit assembly 17. This allows the movement of such things as the keys on the board. Access to the circuitry underneath the structure can be gained simply by lifting the structure, which is either unattached or only temporarily attached by clips and the like, to the underlying assembly shown in FIG. 3.

Referring back to FIG. 5, the outer edge of absorbent structure 21 is cut and sealed to conform to the underlying shape, in the present embodiment, the keyboard circuit assembly 17 of FIG. 3. Further, the edges around formations 23 are also sealed to keep the hydrogel-forming core intact and sandwiched within the unitary structure 21. Although the absorbent structure 21 is shown fitting circuit assembly 17 for a laptop keyboard assembly 11, it is to be understood that the absorbent structure can take any shape and have any number or size of formations 23 that allow for access to and penetration of electronic and mechanical elements. For instance, the absorbent structure 21 could be shaped to fit inside the keypad of a cellular phone, which would typically have fewer number of formations 23 to accommodate the smaller, mostly numerical key pad. The absorbent structure in all embodiments of the present invention is of a unitary form, meaning that all edges are sealed around the periphery and within the formations, thus forming a completely enclosed sandwich structure wherein the hydrogel-forming core is contained within the top sheet and back sheet.

The above-identified application addresses the protection of the electrical circuitry associated with the keyboard or electronic device, but does not address the mechanical compromise resulting in sticky keys or keypads which is sometimes caused by such spills.

Keyboard surfaces generally act as a magnet for dust and other particulate contaminants, which eventually collects in the many crevices provided between the surfaces of individual keys. Previous solutions, applied under conditions where there is known to be considerable exposure to airborne dust particles, have consisted of applying thin latex/rubber-like covers over the full surface of the keyboards. This solution is somewhat unsatisfactory, since it reduces tactile response and cosmetically is unattractive.

Users of mobile laptops, for example, commonly carry their laptops with them. Mobile laptops are therefore much more subject to potential compromise from contamination if a user is eating or drinking at the same time as using a laptop. The dust particulates are then collected during a liquid spill, resulting in poor key actuation due to a phenomenon known as "sticky key" in the industry. U.S. Pat. No. 6,398,436 serves to allow for the liquid and other soluble entities to be quickly absorbed into the super gel absorbent material. However, without the application of a protectant on critical surfaces, residues from a liquid spill may accumulate on sensitive surfaces of the laptop, resulting in keyboard failure due to the "sticky key" phenomenon.

A system and method is added in accordance with the present invention utilizes a protectant on critical surfaces serves to prevent the residual buildup of contaminants following spills. This class of protectant (fluoroaliphatic polymer) is commonly used in commercial products such as 3M Scotchgard. A bottom portion of a key top as well as the mating surfaces underneath are preferably coated with a protectant to prevent the sticky key problem.

Applying protectant in accordance with the present invention is critical, because only a small amount of residue can affect the tactile response of keys on a keyboard or keypad. In some instances, keys may be rendered totally non-functional because of the strength of the adhering forces. For example, sugar residues from soft drinks, no matter how quickly they are removed, generally result in some degree of impaired response on the keyboard or keypad.

Figure 6:
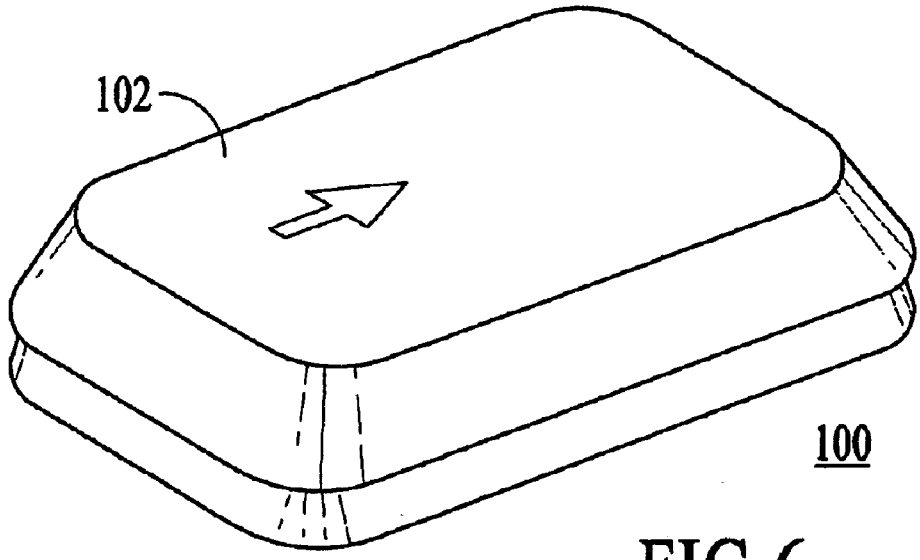
FIG. 6 shows a complete assembly of a single key.
Figure 7:
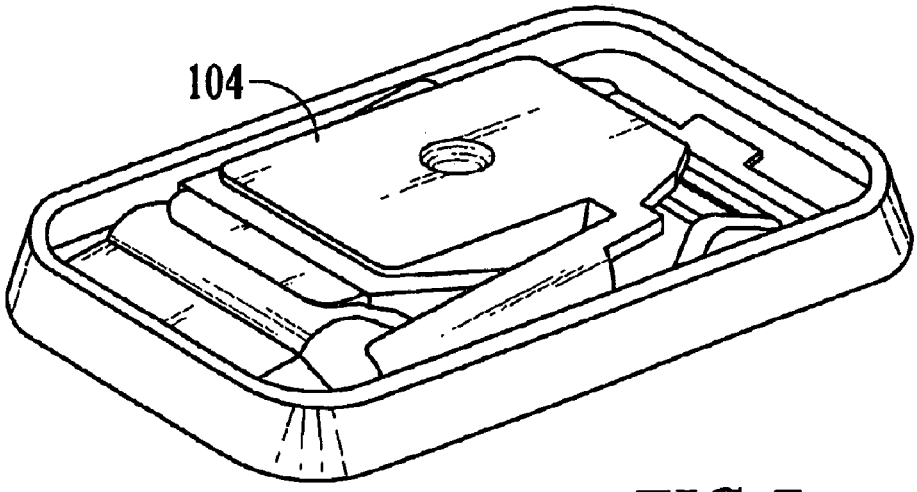
FIG. 7 shows the key top removed revealing the mechanical assembly underneath.
Figure 8:
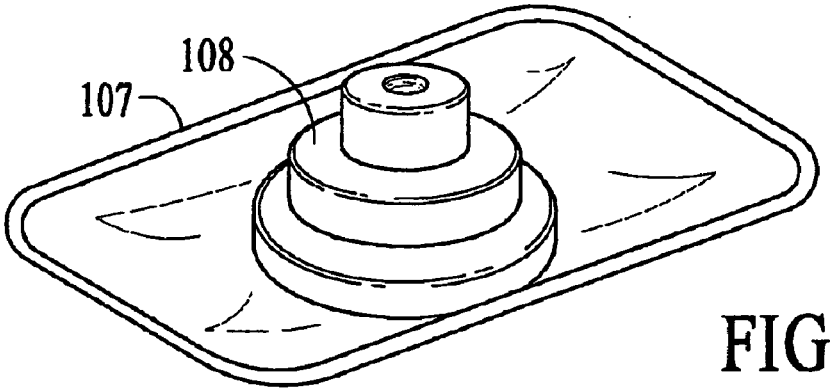
FIG. 8 shows the mechanical assembly removed leaving only the rubber dome.

To illustrate the features of the present invention in more detail, refer now to the following discussion in conjunction with the accompanying figures. FIG. 6 shows a complete assembly of a single key 100. FIG. 7 shows the key top 102 removed revealing the mechanical assembly 104 underneath. FIG. 8 shows the mechanical assembly 104 removed leaving only the rubber dome 106. The key 100 can stick on several surfaces.

An outside edge 107 around the rubber dome 106 shown in FIG. 7 pushes the key top 102 back up. When the key top 102 is pushed down, if there is sticky residue the key top 102 will stay down. Accordingly, there is a mating surface between the key top 102 and the rubber dome 106. There are also mating surfaces underneath the mechanical assembly 104 and the rubber dome 106, as shown in FIG. 7. Referring back to FIG. 6, the bottom of the mechanical assembly of the keybutton is coated, and the corresponding mating surface which contacts the mechanical assembly is also coated. The areas between also could become sticky if a liquid spill occurs. Accordingly, any surfaces coming together that touch would have a tendency to stick.

Figure 9:
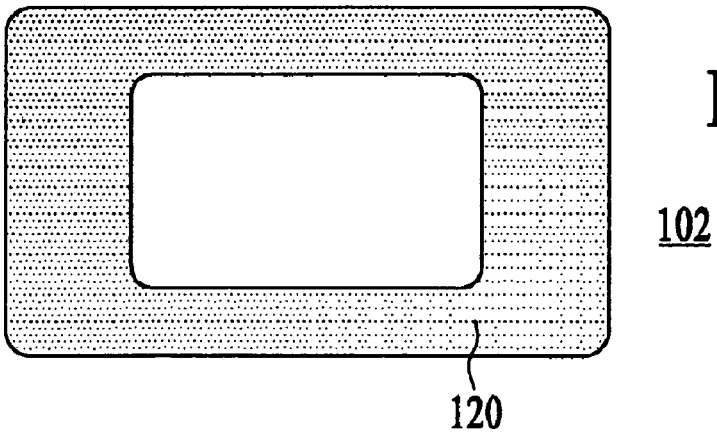
FIG. 9 illustrates a first layer of protectant applied to the mating surface of the key top.
Figure 10:
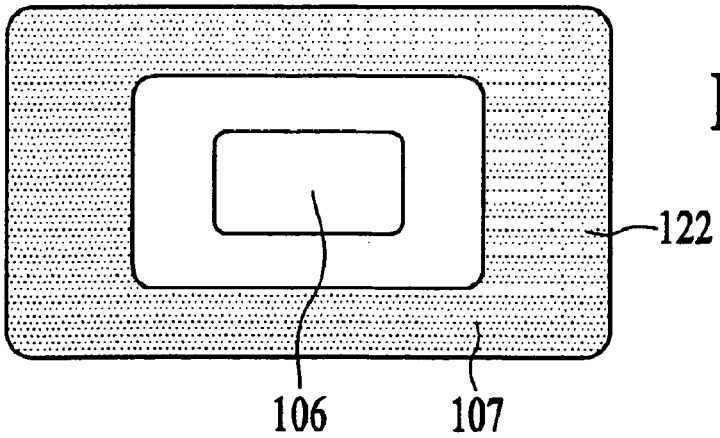
FIG. 10 illustrates a second layer of protectant applied to the mating surface of the rubber dome.

Accordingly, FIG. 9 illustrates a first layer of protectant 120 applied to the mating surface of the key top 102. FIG. 10 illustrates a second layer of protectant 122 applied to the mating surface 107 of the rubber dome.

Present keyboard designs can allow for the surface protectant to be applied on all surfaces without significant problems. Indeed, it is recommended that all surfaces of each of the parts be coated, with the exception of the top side of the key (primarily due to cosmetic reasons).

Accordingly, in a first embodiment of the present invention mating surfaces on the keyboard and body of the device are coated with a protectant such as Scotchgard, thereby preventing the sticking of the surfaces.

In an improvement of the present invention, in a second embodiment, the mating surfaces on the keyboard and keypad are coated with a protectant material such as Scotchgard, in conjunction with the use of an absorbant membrane described in U.S. Pat. No. 6.398,436 which fits over openings between layers in the keyboard. Liquids that are spilled on the top of the keyboard will be then repelled by the protectant material such as Scotch-Gard , and will consequently run around the keys and be absorbed by the membrane absorbent structure beneath. Accordingly, through the cooperation of the protectant and the membrane absorbant structure, the liquid would be repelled by the protectant and the absorbant material would attract the liquid therefore ensuring sticking does not occur.

A system and method is added in accordance with the present invention utilizing a protectant on critical surfaces which serves to prevent the residual buildup of contaminants following spills. In so doing the sticky key problem associated with the contaminated buildup is substantially eliminated.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A method of reversibly absorbing liquid penetrations into electronic devices having a body and circuitry, the method comprising:

providing a protectant coating;

applying the protectant coating on surfaces on the keypad and on the body to prevent sticking between the mating surfaces;

providing an absorbent structure in sheet-like form; and placing the absorbent structure within the electronic device such that the structure covers the electronic circuitry to be protected.

2. The method of claim 1 wherein the protected coating comprises a hydrophobic, highly anti-wetting surface treatment.

3. The method of claim 2 wherein the protectant coating comprises a fluoraliphatic polymer.

4. A system for minimizing sticky keypads in electronic devices, the absorbent system comprising:

a first protectant coating on critical surfaces of the keypad; and a second protectant coating on the mating surfaces to the critical surfaces of the keypad which are located in the body of the device; and a water-permeable top sheet, a hydrogel-forming core, and a back sheet, the combination of elements forming the absorbent structure having a defined thickness; wherein the absorbent structure is characterized by having formations that allow for access to and penetration of electronic and mechanical elements.

5. The system of claim 4 wherein the first and/or second protectant coatings comprises a hydrophobic, highly anti-wetting surface treatment.

6. The system of claim 5 wherein the first and/or second protective coatings comprise a fluoraliphatic polymer.

7. A method of minimizing sticky keys in an electronic device having a body, circuitry, and a plurality of keypads, the method comprising the steps of:

(a) providing a protectant coating wherein the protectant coating comprises a fluoraliphatic polymer; and (b) applying the protectant coating on surfaces on the keypad and on the body to prevent sticking between the mating surfaces.

8. A method of reversibly absorbing liquid penetrations into electronic devices having a body and circuitry, the method comprising:

providing a protectant coating wherein the protectant coating comprises a fluoraliphatic polymer;

applying the protectant coating on surfaces on the keypad and on the body to prevent sticking between the mating surfaces;

providing an absorbent structure in sheet-like form; and placing the absorbent structure within the electronic device such that the structure covers the electronic circuitry to be protected.

9. A system for minimizing sticky keypads in electronic devices, the absorbent system comprising:

a first protectant coating on critical surfaces of the keypad; and a second protectant coating on the mating surfaces to the critical surfaces of the keypad which are located in the body of the device wherein the first and second protective coatings comprise a fluoraliphatic polymer; and a water-permeable top sheet, a hydrogel-forming core, and a back sheet, the combination of elements forming the absorbent structure having a defined thickness; wherein the absorbent structure is characterized by having formations that allow for access to and penetration of electronic and mechanical elements.

* * * * *